US011124900B2

(12) United States Patent
Wang et al.

(10) Patent No.: US 11,124,900 B2
(45) Date of Patent: Sep. 21, 2021

(54) METHOD FOR PREPARING FLAME-RETARDANT CELLULOSIC FIBERS

(71) Applicant: DONGHUA UNIVERSITY, Shanghai (CN)

(72) Inventors: Tiehan Wang, Shanghai (CN); Shiqiang Cui, Shanghai (CN); Hong Jin, Shanghai (CN); Yang Zhang, Shanghai (CN); Yan Liu, Shanghai (CN); Yumei Zhang, Shanghai (CN)

(73) Assignee: DONGHUA UNIVERSITY, Shanghai (CN)

( * ) Notice: Subject to any disclaimer, the term of this patent is extended or adjusted under 35 U.S.C. 154(b) by 0 days.

(21) Appl. No.: 17/058,141

(22) PCT Filed: Oct. 14, 2019

(86) PCT No.: PCT/CN2019/111012

§ 371 (c)(1),
(2) Date: Nov. 24, 2020

(87) PCT Pub. No.: WO2020/173101

PCT Pub. Date: Sep. 3, 2020

(65) Prior Publication Data

US 2021/0198813 A1 Jul. 1, 2021

(30) Foreign Application Priority Data

Feb. 26, 2019 (CN) ..... 201910141840.2

(51) Int. Cl.

| | |
|---|---|
| ***D01F 1/07*** | (2006.01) |
| ***D01F 2/02*** | (2006.01) |
| ***D01D 5/06*** | (2006.01) |
| ***D01D 10/06*** | (2006.01) |
| ***D01F 2/06*** | (2006.01) |

(52) U.S. Cl.

CPC ..... *D01F 1/07* (2013.01); *D01D 5/06* (2013.01); *D01D 10/06* (2013.01); *D01F 2/02* (2013.01); *D01F 2/06* (2013.01)

(58) Field of Classification Search

None

See application file for complete search history.

(56) References Cited

U.S. PATENT DOCUMENTS 3,836,608 A * 9/1974 Borivoj et al. ..... D06M 15/673 558/76
3,866,405 A * 2/1975 Knopka ..... D01F 2/28 57/255
3,874,155 A * 4/1975 Knopka ..... D06M 15/673 57/255
3,986,882 A * 10/1976 Franko-Filipasic ..... C07F 9/65812 106/18.16
4,059,546 A * 11/1977 Knopka ..... C08G 63/181 524/34
4,081,498 A * 3/1978 Maranci ..... D01F 6/54 525/198
4,101,528 A * 7/1978 Knopka ..... C08G 63/181 524/409
5,690,874 A * 11/1997 Bell ..... D06M 13/285 264/129
8,246,865 B2 * 8/2012 Orena Tesouro ..... D01F 2/08 252/601
10,260,195 B1 * 4/2019 Martin ..... D06N 3/0011
10,443,153 B2 * 10/2019 Niemz ..... C08L 1/02
2012/0156486 A1 * 6/2012 Bisjak ..... D01F 2/06 428/375
2013/0228949 A1 * 9/2013 Chou ..... D01D 7/00 264/183
2014/0205830 A1 * 7/2014 Malinowsky ..... D01F 1/07 428/221
2016/0201236 A1 * 7/2016 Matsumoto ..... D01F 6/40 2/243.1
2020/0240043 A1 * 7/2020 Malinowsky ..... D01F 2/24

FOREIGN PATENT DOCUMENTS

| | | | |
|---|---|---|---|
| CN | 103590126 | A | 2/2014 |
| CN | 108018715 | A | 5/2018 |
| GN | 105316881 | A | 2/2016 |
| GN | 106367949 | A | 2/2017 |
| GN | 110172740 | A | 8/2019 |
| JP | 2001329461 | A | 11/2001 |

* cited by examiner

*Primary Examiner* — Xiao S Zhao
*Assistant Examiner* — Emmanuel S Luk
(74) *Attorney, Agent, or Firm* — Bayramoglu Law Offices LLC

(57) ABSTRACT

A type of flame-retardant cellulosic fiber and a preparation method thereof are disclosed. The preparation method includes extruding the cellulosic solution through a spinneret, coagulating, stretching, and water-washing to obtain a water-washed filament, which is then treated with a flame-retardant solution, and then rinsed and dried to prepare the flame-retardant cellulosic fiber. The water-washing temperature is ≤90° C., the temperature of the flame-retardant solution during treatment is 60-90° C., and the rinsing temperature is 20-40° C. The flame retardant contains more than one of a group that forms a covalent bond with a hydroxy group of the cellulosic macromolecule, a group having the ability of self-crosslinking reaction, and a group that forms a hydrogen bond with a hydroxy group of the cellulosic macromolecule. The prepared flame-retardant cellulosic fiber is mainly composed of the cellulosic fiber matrix and the flame retardant dispersed in the matrix.

8 Claims, No Drawings

METHOD FOR PREPARING FLAME-RETARDANT CELLULOSIC FIBERS

CROSS REFERENCE TO THE RELATED APPLICATIONS

This application is the national phase entry of International Application No. PCT/CN2019/111012, filed on Oct. 14, 2019, which is based upon and claims priority to Chinese Patent Application No. 201910141840.2, filed on Feb. 26, 2019, the entire contents of which are incorporated herein by reference.

TECHNICAL FIELD

The invention belongs to the technical field of fiber manufacturing, and relates to a type of flame-retardant cellulosic fiber and a preparation method thereof.

BACKGROUND

The cotton fiber and the hemp fiber of cellulose fibers are the most important textile materials for a long time due to good thermal insulation properties of their products, which are renewable, non-toxic, comfortable, healthy, degradable and no white pollution. With the development of society, the polyester fiber has replaced its role to a certain extent, but it is still the main textile materials. However, with the continuous development of the market, the demand for cellulose fibers is increasing. The output of natural cellulose fibers such as cotton and hemp is limited, and is difficult to meet the increasing consumer demands. Therefore, the man-made cellulose fiber (regenerated cellulose fiber) has been developed, which is prepared by natural materials such as cotton linters, wood, bamboo, bagasse, reeds and so on, to reshape its cellulose molecules through a certain processing method. It effectively utilizes natural materials and greatly improves the supply of the cellulose fiber. With the further upgrade of consumer demands, the market not only demands for more cellulose fibers, but also requires higher quality and functionality of the fiber.

In recent years, fires caused by textiles have gradually increased, among which bedding, decorative fabrics and clothing fabrics are the main sources of fire. Therefore, the industry pays more and more attention to the flame retardancy of textiles. Many developed countries such as the United States have legislated to stipulate that flame-retardant textiles must be used in specific situations such as pajamas for the elderly and children, bedding, hotels, aviation decoration fabrics, shed covers for storage and so on. Foreign flame-retardant technology has a long history, and production and consumption of flame retardants have reached a considerable scale, becoming the second largest category of additives after plasticizers. The development of flame-retardant technology and flame retardants in China is relatively slow, but the flame retardancy of textiles has become an urgent need with the development of society.

At present, there are several methods for preparing flame-retardant cellulose fibers: one is the dope addition method, that is, adding flame-retardant additives to the spinning solution and spinning to prepare flame-retardant fibers. It is a common technical method for the flame retardancy of regenerated cellulose fibers, which can significantly improve the flame-retardant effect, but also have shortcomings: 1) the flame-retardant additives are easy to remain in the spinning equipment and coagulating-washing system, which affects normal production and solvent recycling; 2) the degree of dispersion and the amount of flame-retardant additives will have an adverse effect on the mechanical properties of the fiber; 3) The batch replacement in production is not flexible, and there are too many transitional filaments to increase production costs. Another is the fiber or fabric post-treatment method, which can be applied generally to both natural fibers and regenerated fibers. The advantages are that the amount of batches can be adjusted, the production conversion is flexible, and the variety is adaptable, while the disadvantages are: 1) the general treatment may lead to poor durability, but the method that reactive finishing improves durability, is limited to the categories of flame-retardant additives, which is only suitable for a few flame-retardant additives that can react, and increases reaction processes and the recycling of unreacted flame-retardant additives; 2) the finishing affects not only the function of fibers or fabrics, but also the feel, softness, and air permeability of fibers and fabrics, and even causes shrinkage of fibers or fabrics; 3) the finished product has a compact fiber microstructure, and the post-treatment mainly occurs on the fiber surface, where the amount of additional flame-retardant additives is limited, affecting the flame retardancy or improving reactivity by swelling or activating, which undoubtedly increases the cost of procedures and solvent treatments.

Therefore, it is of great practical significance to develop a method for preparing flame-retardant cellulosic fibers with excellent flame retardancy and durability.

SUMMARY

The invention is aimed to develop a method for preparing a flame-retardant cellulosic fiber with excellent flame retardancy and durability against the defect that the prior art cannot ensure flame retardancy and durability at the same time.

To this end, the technical schemes of the invention are as follows:

A method for preparing a flame-retardant cellulosic fiber is characterized in that extruding a cellulosic solution through a spinneret, coagulating, stretching, and water-washing to obtain a water-washed filament, treating the water-washed filament with a flame retardant solution to obtain a treated filament, and then rinsing and drying the treated filament to prepare the flame-retardant cellulosic fiber;

wherein a temperature during the water-washing is 90° C., a temperature of the flame-retardant solution during the treating is 60-90° C., and a temperature during the rinsing is 20-40° C.;

a flame retardant comprises more than one groups selected from the group consisting of a X group, a Y group and a Z group; wherein the X group is a group forming a covalent bond with a hydroxy group of a cellulosic macromolecule, the Y group is a group having an ability of self-crosslinking reaction, and the Z group is a group forming a hydrogen bond with the hydroxy group of the cellulosic macromolecule.

First of all, the residual spinning solvent is removed from the filaments through water-washing at the temperature of ≥90° C. On one hand, it significantly accelerates the diffusion speed of the spinning solvent, and improves the speed and efficiency of washing. On the other hand, the cellulosic fiber is expanded at high water-washing temperature, causing the larger holes on the fiber surface, that is, loose microporous structures;

Next, after the water-washing, the water-washed filament is treated by the 60-90° C. flame-retardant solution. Under the treatment of a flame-retardant solution at a suitable temperature, the structure of micropores on the fiber surface can keep loosen, which speeds up the penetration of the flame retardant into the fiber through the holes on the fiber surface. At the same time, the solubility of the flame retardant is higher at high temperature, which can increase the concentration of the flame-retardant solution, while the molecular thermal movement of the flame retardant in the flame-retardant solution at higher temperature is relatively violent, which speeds up the penetration of the flame retardant into the fiber and reach equilibrium in a short time, thereby shortening the flame retardant treatment. If the temperature of the flame-retardant solution is too high, it will spread too fast to distribute evenly, and affect the mechanical properties of the fiber, while the intensify reaction of the flame retardant in water will reduce the flame retardant and affect the flame retardancy. If the temperature of the flame-retardant solution is too low, it will spread too slow to have a good reaction rate and a good flame retardancy;

Then, after the flame-retardant treatment, the invention will be rinsed at 20-40° C. The lower rinsing temperature can shrink the holes on the surface of the previously opened fiber to ensure that the flame retardant penetrating into the fiber is firmly attached to the fiber, which greatly improves the fastness between the flame retardant and the fiber, and the water-washing resistance of the fiber. At the same time, the lower temperature can ensure that the internal flame retardant will not diffuse rapidly due to the difference in internal and external concentration, and it saves energy. If the temperature is too high, the internal unreacted flame retardant will be washed out easily, so that the flame retardant that reacts with the cellulose fiber during drying is declined, reducing the flame retardancy. If the temperature is too low, it will produce undesirable effects, such as shrinkage, decrease in mechanical properties, etc.;

Finally, the fiber crystallizes further and its microporous structure shrinks further during drying. Due to the X, Y or Z groups in the flame retardant and the group in the cellulosic fiber have a strong interaction, a flame-retardant cellulosic fiber with excellent durability and flame retardancy is prepared.

The following preferred technology program is presented to give a detailed description for the preparation method of a flame-retardant cellulosic fiber:

wherein a concentration of the cellulosic solution is 5-25 wt %, which can be adjusted by technicians in this field within a certain range as required. With increasing concentration of the spinning solution, the diffusion coefficient of the entire system will continue to decrease, and the concentration of the spinning solution will affect the phase separation during the spinning process. If the concentration of the spinning solution is too low, it may not occur phase transition and prepare the fiber, or it only forms a loose and uneven structure during phase transition, which reduces the mechanical properties of the fiber; if the concentration is too high, it is equivalent to dry spinning, preparing fiber with a compact structure, which is not conducive to the subsequent flame retardant process; the cellulosic fiber is a regenerated cellulose fiber or a cellulose derivative fiber.

wherein the cellulosic fiber is a viscose fiber, an acetate fiber, a Lyocell fiber, a cupro fiber, a regenerated cellulosic fiber prepared with an ionic liquid as a solvent, or a regenerated cellulosic fiber prepared with an alkaline solution as the solvent. The cellulosic fiber in this invention contains more than above, herein only cited some examples.

wherein a termination condition of the water-washing is: a water content in the water-washed filament is 40-70 wt %, whose crystallinity is less than 15%, the average micropore diameter is 10-200 nanometers, and the micropore volume is 10-30% of the total volume of the water-washed filament. If the water content of the water-washed filament is too low, that is, the fiber is over-dried, the amount and the diameter of micropores in the fiber are reduced, which prevents the flame retardant from entering the fiber; if the water content is too high, the micropores contain too much water, causing a certain pressure difference with outside, which also prevents the flame retardant from entering the fiber.

wherein the X group is an aldehyde group, a cyano group, an epoxy group, an acyl chloride group, an acid anhydride or a diisocyanate; the Y group is a siloxane; the Z group is a sulfonic group or a sulfate ester group. The X, Y, and Z groups in this invention contains more than above, herein only cited some examples.

wherein a mass content of the flame retardant in the flame-retardant solution is 10-30 wt %, which can be adjusted by technicians in this field within a certain range as required. If the concentration is too high, the amount of flame retardant that enters the fiber is equivalent, which causes a waste of materials; if the concentration is too low, the amount of flame retardant that enters the fiber is less, which is difficult to achieve a good flame retardancy; in addition, the mass content of the flame retardant is also related to the type of flame retardant. The smaller the structure of the flame retardant, the easier it is to enter the fiber, and the less mass content required for the flame retardant in the solution; the flame retardant is more than one selected from the group consisting of a halogenated flame retardant, a phosphorus flame retardant and a nitrogen-phosphorus flame retardant. The type of flame retardants in this invention contains more than above, herein only cited some examples.

wherein treating is soaking or spraying, and a time of the treating is 60-600 seconds; a time of the rinsing is 10-120 seconds. The process of this invention contains more than above, herein only cited soaking and spraying as examples. The time of the treating is related to the category of flame retardants. If the time of the treating is too short, the flame retardant doesn't fully diffuse into the fiber, so the flame retardancy of the fiber is not good; if the time of the treating is too long, it will not only affect efficiency, but also make the fiber harder and the feel worse, affecting the mechanical properties. The time of the rinsing in this invention can also be adjusted by technicians in this field according to the situation.

wherein the drying uses hot air until a water content of the flame-retardant cellulosic fiber is <15 wt %, and a temperature of the hot air is 100-200° C. The drying method in this invention contains more than above, herein only taken hot air drying as an example. It can also be dried at room temperature, but it takes relatively long time, affecting the efficiency of fiber preparation to a certain extent.

wherein the flame-retardant cellulosic fiber comprises a cellulosic fiber matrix and the flame retardant dispersed in the cellulosic fiber matrix.

The following preferred technology program is presented to give a detailed description for the flame-retardant cellulosic fiber:

wherein a crystallinity is >30%, an average diameter of micropores contained in the flame-retardant cellulosic fiber is 5-50 nanometers, and a mass of the flame retardant is 5-15% of a mass of the cellulosic fiber matrix;

wherein a monofilament fineness is 0.5-5.0 dtex, a breaking strength is 1.0-4.0 cN/dtex, an elongation at break is 5%-20%, a moisture regain is 5%-15%. Before the water-washing, a limiting oxygen index of the flame-retardant cellulosic fiber is above 45%; after 50 times of the water-washing, the mass of the flame retardant is 3-13% of the mass of the cellulosic fiber matrix, and the limiting oxygen index of the flame-retardant cellulosic fiber is above 35%;

wherein the flame-retardant cellulosic fiber is a filament, a staple or a tow, and is applied in knitted fabrics, woven fabrics, non-woven fabrics or mixed with other fibers.

Invention mechanism:

In the invention, a flame-retardant cellulosic fiber with excellent durability, mechanical properties and flame retardancy is prepared by interacting the temperatures of water-washing, flame-retardant solution during treating and rinsing.

In the invention, the residual spinning solvent is removed from the filaments through water-washing at the temperature of ≥90° C. On one hand, it significantly accelerates the diffusion speed of the spinning solvent, and improves the speed and efficiency of washing. On the other hand, the cellulosic fiber is expanded at high water-washing temperature, causing the larger holes on the fiber surface, that is, loose microporous structures; after the water-washing, the water-washed filament is treated by the 60-90° C. flame-retardant solution. Under the treatment of a flame-retardant solution at a suitable temperature, the structure of micropores on the fiber surface can keep loosen, which speeds up the penetration of the flame retardant into the fiber through the holes on the fiber surface. At the same time, the solubility of the flame retardant is higher at high temperature, which can increase the concentration of the flame-retardant solution, while the molecular thermal movement of the flame retardant in the flame-retardant solution at higher temperature is relatively violent, which speeds up the penetration of the flame retardant into the fiber and reach equilibrium in a short time, thereby shortening the flame retardant treatment. If the temperature of the flame-retardant solution is too high, it will spread too fast to distribute evenly, and affect the mechanical properties of the fiber, because the intensify reaction of the flame retardant in water will reduce the flame retardant and affect the flame retardancy. If the temperature of the flame-retardant solution is too low, it will spread too slow to have a good reaction rate and a good flame retardancy; after the flame-retardant treatment, the invention will be rinsed at 20-40° C. The lower rinsing temperature can shrink the holes on the surface of the previously opened fiber to ensure that the flame retardant penetrating into the fiber is firmly attached to the fiber, which greatly improves the fastness between the flame retardant and the fiber, and the water-washing resistance of the fiber. At the same time, the lower temperature can ensure that the internal flame retardant will not diffuse rapidly due to the difference in internal and external concentration, and it saves energy. If the temperature is too high, the internal unreacted flame retardant will be washed out easily, so that the flame retardant that reacts with the cellulose fiber during drying is declined, reducing the flame retardancy. If the temperature is too low, it will produce undesirable effects, such as shrinkage, decrease in mechanical properties, etc.; finally, the fiber crystallizes further and its microporous structure shrinks further during drying. Due to the X, Y or Z groups in the flame retardant and the group in the cellulosic fiber have a strong interaction, a flame-retardant cellulosic fiber with excellent durability and flame retardancy is prepared.

Benefits:

(1) The method for preparing flame-retardant cellulosic fibers in the invention doesn't need to add flame-retardant additives before spinning, which doesn't affect the extrusion molding process of the fiber, the recycling of solvents and the spinning process. The method is flexible, suitable for both mass production and small batch production with multi-variety;

(2) The method for preparing flame-retardant cellulosic fibers in the invention is simple to apply and conditioned mildly;

(3) The flame-retardant cellulosic fiber of the invention has excellent mechanical properties, water-washing resistance and flame retardancy, expecting a good market prospect.

DETAILED DESCRIPTION OF THE EMBODIMENTS

Based on above mentioned method, the following embodiments are carried out for further demonstration in this invention. It is to be understood that these embodiments are only intended to illustrate the invention and are not intended to limit the scope of the invention. In addition, it should be understood that after reading the contents described in the present invention, those technicians in this field can make various changes or modifications to this invention, and these equivalent forms also fall within the scope of the claims attached to the application.

Example 1

A method for preparing flame-retardant cellulosic fibers, comprising steps as follows:

(1) Preparation of viscose spinning solution with a concentration of 5 wt %;

(2) Extruding the spinning solution through a spinneret, coagulating, stretching, and water-washing to obtain a water-washed filament; the temperature during the water-washing is 90° C.; the termination condition of the water-washing is: the water content in the water-washed filament is 40 wt %;

(3) Soaking the water-washed filament with the flame-retardant solution. The mass content of the flame retardant in the flame-retardant solution is 10 wt %; the flame retardant is alkoxycyclotriphosphazene; the temperature of the flame-retardant solution during the soaking is 60° C.; the time of the soaking is 60 seconds;

(4) Rinsing and drying the soaked water-washed filament to obtain flame-retardant cellulosic fibers. The temperature during the rinsing is 20° C. and the time of the rinsing is 10 seconds. The drying method is hot air drying, and the temperature of the hot air is 100° C., which is terminated when the water content of the fiber is 14.9 wt %.

The prepared flame-retardant cellulosic fiber is a filament, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 5 nanometers, wherein the crystallinity is 31%, the mass of the flame retardant is 5% of the mass of the cellulosic fiber matrix, the monofilament fineness is 0.5 dtex, the breaking strength is 1.0 cN/dtex, the elongation at break is 5%, and the moisture regain is 5%. Before the water-washing, the limiting oxygen index of the flame-retardant cellulosic fiber is 45%. After 50 times of the water-washing, the mass of the flame retardant is 3% of the mass of the cellulosic fiber matrix, and the limiting oxygen index of the flame-retardant cellulosic fiber is 35%.

Comparison 1

A method for preparing cellulosic fibers comprises steps basically the same as those in Example 1, except for the temperature during the water-washing in step (2) is 80° C. The crystallinity of the prepared cellulosic fiber is 30%, the mass of the flame retardant is 3.2% of the mass of the cellulosic fiber matrix, the monofilament fineness is 0.4 dtex, the breaking strength is 1.0 cN/dtex, the elongation at break is 6%, and the moisture regain is 5%. Before the water-washing, the limiting oxygen index of the cellulosic fiber is 30%. After 50 times of the water-washing, the mass of the flame retardant is 2.1% of the mass of the cellulosic fiber matrix, and the oxygen index is 20%.

Comparison 2

A method for preparing cellulosic fibers comprises steps basically the same as those in Example 1, except that the temperature of the flame-retardant solution during soaking in step (3) is 50° C. The crystallinity of the prepared cellulosic fiber is 30%, the mass of the flame retardant is 2.5% of the mass of the cellulosic fiber matrix, the monofilament fineness is 0.5 dtex, the breaking strength is 0.9 cN/dtex, the elongation at break is 6%, and the moisture regain is 5%. Before the water-washing, the limiting oxygen index of the cellulosic fiber is 25%. After 50 times of the water-washing, the mass of the flame retardant is 1.9% of the mass of the cellulosic fiber matrix, and the oxygen index is 18%.

Comparison 3

A method for preparing cellulosic fibers comprises steps basically the same as those in Example 1, except that the temperature during the rinsing in step (4) is 50° C. The crystallinity of the prepared cellulosic fiber is 29%, the mass of the flame retardant is 3.5% of the mass of the cellulosic fiber matrix, the monofilament fineness is 0.5 dtex, the breaking strength is 0.5 cN/dtex, the elongation at break is 5%, and the moisture regain is 6%. Before the water-washing, the limiting oxygen index of the cellulosic fiber is 32%. After 50 times of the water-washing, the mass of the flame retardant is 1.5% of the mass of the cellulosic fiber matrix, and the oxygen index is 16%.

Comparing Example 1 and Comparisons 1-3, it is shown that this invention significantly improves the durability, mechanical properties and flame retardancy of cellulosic fibers by interacting the temperature during the water-washing, the temperature of the flame-retardant solution during the treating and the temperature during the rinsing. This is because the higher water-washing temperature speeds up the diffusion rate of solvents, which can quickly wash out the residual solvent in the nascent fiber, so that the solvent and the flame retardant will not interact in the subsequent process and influence the effect. The higher temperature also increases the holes inside the fiber, which is conducive for the flame retardant entering into the fiber. When the dyeing flame-retardant solution is processed, the appropriate temperature can keep the microporous structures of fiber surface loosen after water-washing, accelerating the speed of the flame retardant penetrating into the fiber through the holes on the fiber surface, which makes the flame retardant enter the fiber quickly and reaches balance in a short time, thereby shortening the treating time while at this temperature, it will not react itself due to the high temperature. Then at the subsequent lower rinsing temperature, the holes inside the fiber can be shrunk, and the unreacted flame retardant on the surface can be washed out without washing the flame retardant inside the fiber, so that sufficient and uniform dyes can be maintained in the fiber, significantly improving the durability and mechanical properties of flame-retardant fibers.

Comparison 4

A method for preparing cellulosic fibers comprises steps basically the same as those in Example 1, except that the step (4) is not rinsed. The crystallinity of the prepared cellulosic fiber is 28%, the mass of the flame retardant is 4.1% of the mass of the cellulosic fiber matrix, the monofilament fineness is 0.4 dtex, the breaking strength is 0.4 cN/dtex, the elongation at break is 6%, and the moisture regain is 6%. Before the water-washing, the limiting oxygen index of the cellulosic fiber is 40%. After 50 times of the water-washing, the mass of the flame retardant is 1.2% of the mass of the cellulosic fiber matrix, and the oxygen index is 14%.

Comparing Example 1 and Comparison 4, it is shown that this invention significantly improves the flame retardancy of flame-retardant cellulosic fibers by rinsing. By rinsing and controlling the rinsing temperature to a lower level, the holes on the fiber surface that have been opened before can be shrunk to ensure the flame retardant that penetrates into the fiber is firmly attached to the fiber, which greatly improves the fastness between the flame retardant and the fiber, and improves the water-washing resistance of the fiber.

Example 2

A method for preparing flame-retardant cellulosic fibers, comprising steps as follows:

(1) Preparation of acetate spinning solution with a concentration of 25 wt %;

(2) Extruding the spinning solution through a spinneret, coagulating, stretching, and water-washing to obtain a water-washed filament; the temperature during the water-washing is 99° C.; the termination condition of the water-washing is: the water content in the water-washed filament is 70 wt %;

(3) Spraying the water-washed filament with the flame-retardant solution. The mass content of the flame retardant in the flame-retardant solution is 30 wt %; the flame retardant is halogenphosphazene; the temperature of the flame-retardant solution during the spraying is 90° C.; the time of the spraying is 600 seconds;

(4) Rinsing and drying the sprayed water-washed filament to obtain flame-retardant cellulosic fibers. The temperature during the rinsing is 40° C. and the time of the rinsing is 120 seconds. The drying method is hot air drying, and the temperature of the hot air is 200° C., which is terminated when the water content of the fiber is 13.5 wt %.

The prepared flame-retardant cellulosic fiber is a staple, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 50 nanometers, wherein the crystallinity is 33%, the mass of the flame retardant is 15% of the mass of the cellulosic fiber matrix, the monofilament fineness is 5.0 dtex, the breaking strength is 4.0 cN/dtex, the elongation at break is 20%, and the moisture regain is 15%. Before the water-washing, the limiting oxygen index of the flame-retardant cellulosic fiber is 45%. After 50 times of the water-washing, the mass of the flame retardant is 12% of the mass of the cellulosic fiber matrix, and the limiting oxygen index of the flame-retardant cellulosic fiber is 38%.

Example 3

A method for preparing flame-retardant cellulosic fibers, comprising steps as follows:

(1) Preparation of Lyocell spinning solution with a concentration of 15 wt %;

(2) Extruding the spinning solution through a spinneret, coagulating, stretching, and water-washing to obtain a water-washed filament; the temperature during the water-washing is 35° C.; the termination condition of the water-washing is: the water content in the water-washed filament is 55 wt %;

(3) Soaking the water-washed filament with the flame-retardant solution. The mass content of the flame retardant in the flame-retardant solution is 19 wt %; the flame retardant is halogenated phosphite; the temperature of the flame-retardant solution during the soaking is 75° C.; the time of the soaking is 330 seconds;

(4) Rinsing and drying the soaked water-washed filament to obtain flame-retardant cellulosic fibers. The temperature during the rinsing is 30° C. and the time of the rinsing is 65 seconds. The drying method is hot air drying, and the temperature of the hot air is 125° C., which is terminated when the water content of the fiber is 14 wt %.

The prepared flame-retardant cellulosic fiber is a tow, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 20 nanometers, wherein the crystallinity is 31%, the mass of the flame retardant is 12% of the mass of the cellulosic fiber matrix, the monofilament fineness is 2.8 dtex, the breaking strength is 2.5 cN/dtex, the elongation at break is 12%, and the moisture regain is 11%. Before the water-washing, the limiting oxygen index of the flame-retardant cellulosic fiber is 46%. After 50 times of the water-washing, the mass of the flame retardant is 10% of the mass of the cellulosic fiber matrix, and the limiting oxygen index of the flame-retardant cellulosic fiber is 35%.

Example 4

A method for preparing flame-retardant cellulosic fibers, comprising steps as follows:

(1) Preparation of cupro spinning solution with a concentration of 8 wt %;

(2) Extruding the spinning solution through a spinneret, coagulating, stretching, and water-washing to obtain a water-washed filament; the temperature during the water-washing is 92° C.; the termination condition of the water-washing is: the water content in the water-washed filament is 45 wt %;

(3) Spraying the water-washed filament with the flame-retardant solution. The mass content of the flame retardant in the flame-retardant solution is 18 wt %; the flame retardant is N-hydroxymethyl-3-dimethoxyphosphonyl propionamide; the temperature of the flame-retardant solution during the spraying is 70° C.; the time of the spraying is 500 seconds;

(4) Rinsing and drying the sprayed water-washed filament to obtain flame-retardant cellulosic fibers. The temperature during the rinsing is 25° C. and the time of the rinsing is 35 seconds. The drying method is hot air drying, and the temperature of the hot air is 125° C., which is terminated when the water content of the fiber is 14 wt %.

The prepared flame-retardant cellulosic fiber is a filament, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 14 nanometers, wherein the crystallinity is 32%, the mass of the flame retardant is 14% of the mas of the cellulosic fiber matrix, the monofilament fineness is 1.9 dtex, the breaking strength is 2.1 cN/dtex, the elongation at break is 9.5%, and the moisture regain is 10%. Before the water-washing, the limiting oxygen index of the flame-retardant cellulosic fiber is 50%. After 50 times of the water-washing, the mass of the flame retardant is 13% of the mass of the cellulosic fiber matrix, and the limiting oxygen index of the flame-retardant cellulosic fiber is 40%.

Example 5

A method for preparing flame-retardant cellulosic fibers, comprising steps as follows:

(2) Preparation of regenerated cellulosic solution with a concentration of 20 wt % using ionic liquid as a solvent, which is 1-butyl-3-methylimidazolium chloride([BMIM]Cl). The regenerated cellulose fiber is prepared through dry jet wet spinning with ionic liquid as the solvent and the dissolved cellulose pulp;

(2) Extruding the spinning solution through a spinneret, coagulating, stretching, and water-washing to obtain a water-washed filament; the temperature during the water-washing is 93° C.; the termination condition of the water-washing is: the water content in the water-washed filament is 60 wt %;

(3) Soaking the water-washed filament with the flame-retardant solution. The mass content of the flame retardant in the flame-retardant solution is 15 wt %; the flame retardant is N-hydroxymethyl-3-dimethoxyphosphonyl propionamide; the temperature of the flame-retardant solution during the soaking is 60° C.; the time of the soaking is 120 seconds;

(4) Rinsing and drying the soaked water-washed filament to obtain flame-retardant cellulosic fibers. The temperature during the rinsing is 30° C. and the time of the rinsing is 20 seconds. The drying method is hot air drying, and the temperature of the hot air is 120° C., which is terminated when the water content of the fiber is 14.5 wt %.

The prepared flame-retardant cellulosic fiber is a filament, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 30 nanometers, wherein the crystallinity is 31%, the mass of the flame retardant is 12% of the mass of the cellulosic fiber matrix, the monofilament fineness is 1.5 dtex, the breaking strength is 2.1 cN/dtex, the elongation at break is 10%, and the moisture regain is 9%. Before the water-washing, the limiting oxygen index of the flame-retardant cellulosic fiber is 48%. After 50 times of the water-washing, the mass of the flame retardant is 10% of the mass of the cellulosic fiber matrix, and the limiting oxygen index of the flame-retardant cellulosic fiber is 39%.

Example 6

A method for preparing flame-retardant cellulosic fibers, comprising steps as follows:

(2) Preparation of regenerated cellulosic solution with a concentration of 22 wt % using alkaline solution as a solvent, which is a carbamate/NaOH system. The regenerated cellulose fiber is prepared by the fibrillation precipitated from the solution in the acid fluid, wherein the solution is deaerated and filtrated with the carbamate/NaOH as the solvent and the dissolved cellulose pulp;

(2) Extruding the spinning solution through a spinneret, coagulating, stretching, and water-washing to obtain a water-washed filament; the temperature during the water-washing is 91° C.; the termination condition of the water-washing is: the water content in the water-washed filament is 40 wt %;

(3) Spraying the water-washed filament with the flame-retardant solution. The mass content of the flame retardant in the flame-retardant solution is 20 wt %; the flame retardant is halogenphosphazene/alkoxycyclotriphosphazene (mixture with a mass ratio of 1:1); the temperature of the flame-retardant solution during the spraying is 80° C.; the time of the spraying is 600 seconds;

(4) Rinsing and drying the sprayed water-washed filament to obtain flame-retardant cellulosic fibers. The temperature during the rinsing is 20° C. and the time of the rinsing is 40 seconds. The drying method is hot air drying, and the temperature of the hot air is 105° C., which is terminated when the water content of the fiber is 14 wt %.

The prepared flame-retardant cellulosic fiber is a staple, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 20 nanometers, wherein the crystallinity is 32%, the mass of the flame retardant is 12% of the mass of the cellulosic fiber matrix, the monofilament fineness is 1.1 dtex, the breaking strength is 1.2 cN/dtex, the elongation at break is 18%, and the moisture regain is 14%. Before the water-washing, the limiting oxygen index of the flame-retardant cellulosic fiber is 45%. After 50 times of the water-washing, the mass of the flame retardant is 10% of the mass of the cellulosic fiber matrix, and the limiting oxygen index of the flame-retardant cellulosic fiber is 37%.

Example 7

A method for preparing flame-retardant cellulosic fibers, comprising steps as follows:

(1) Preparation of viscose spinning solution with a concentration of 12 wt %;

(2) Extruding the spinning solution through a spinneret, coagulating, stretching, and water-washing to obtain a water-washed filament; the temperature during the water-washing is 90° C.; the termination condition of the water-washing is: the water content in the water-washed filament is 40 wt %;

(3) Soaking the water-washed filament with the flame-retardant solution. The mass content of the flame retardant in the flame-retardant solution is 25 wt %; the flame retardant is halogenphosphazene/alkoxycyclotriphosphazene/N-hydroxymethyl-3-dimethoxyphosphonyl propionamide (mixture with a mass ratio of 1:1:1); the temperature of the flame-retardant solution during the soaking is 90° C.; the time of the soaking is 100 seconds;

(4) Rinsing and drying the soaked water-washed filament to obtain flame-retardant cellulosic fibers. The temperature during the rinsing is 20° C. and the time of the rinsing is 40 seconds. The drying method is hot air drying, and the temperature of the hot air is 125° C., which is terminated when the water content of the fiber is 12 wt %.

The prepared flame-retardant cellulosic fiber is a tow, which is applied in knitted fabrics, woven fabrics, non-woven fabrics or mixed with other fibers, mainly composed of the cellulosic fiber matrix and the flame retardant dispersed in the cellulosic fiber matrix. The flame-retardant cellulosic fiber contains micropores with average diameters of 7 nanometers, wherein the crystallinity is 31%, the mass of the flame retardant is 13% of the mass of the cellulosic fiber matrix, the monofilament fineness is 3.5 dtex, the breaking strength is 3.9 cN/dtex, the elongation at break is 18%, and the moisture regain is 14%. Before the water-washing, the limiting oxygen index of the flame-retardant cellulosic fiber is 46%. After 50 times of the water-washing, the mass of the flame retardant is 12% of the mass of the cellulosic fiber matrix, and the limiting oxygen index of the flame-retardant cellulosic fiber is 39%.

What is claimed is:

1. A method for preparing a flame-retardant cellulosic fiber, comprising: extruding a cellulosic solution through a spinneret, coagulating, stretching, and water-washing to obtain a water-washed filament, treating the water-washed filament with a flame retardant solution to obtain a treated filament, and then rinsing and drying the treated filament to prepare the flame-retardant cellulosic fiber;

wherein a temperature during the water-washing is ≤90° C., a temperature of the flame-retardant solution during the treating is 60-90° C., and a temperature during the rinsing is 20-40° C.;

a flame retardant comprises more than one groups selected from the group consisting of a X group, a Y group and a Z group; wherein the X group is a group forming a covalent bond with a hydroxy group of a cellulosic macromolecule, the Y group is a group having an ability of self-crosslinking reaction, and the Z group is a group forming a hydrogen bond with the hydroxy group of the cellulosic macromolecule.

2. The method of claim 1, wherein a concentration of the cellulosic solution is 5-25 wt %; and the flame-retardant cellulosic fiber is a regenerated cellulose fiber or a cellulose derivative fiber.

3. The method of claim 2, wherein the flame-retardant cellulosic fiber is a viscose fiber, an acetate fiber, a Lyocell fiber, a cupro fiber, a regenerated cellulosic fiber prepared with an ionic liquid as a solvent, or a regenerated cellulosic fiber prepared with an alkaline solution as the solvent.

4. The method of claim 1, wherein a termination condition of the water-washing is: a water content in the water-washed filament is 40-70 wt %.

5. The method of claim 1, wherein the X group is an aldehyde group, a cyano group, an epoxy group, an acyl chloride group, an acid anhydride or a diisocyanate; the Y group is a siloxane; the Z group is a sulfonic group or a sulfate ester group.

6. The method of claim 5, wherein a mass content of the flame retardant in the flame-retardant solution is 10-30 wt %; the flame retardant is more than one selected from the group consisting of a halogenated flame retardant, a phosphorus flame retardant and a nitrogen-phosphorus flame retardant.

7. The method of claim 1, wherein the treating is soaking or spraying, and a time of the treating is 60-600 seconds; a time of the rinsing time is 10-120 seconds.

8. The method of claim 1, wherein the drying uses hot air unto a water content of the flame-retardant cellulosic fiber is <15 wt %, and a temperature of the hot air is 100-200'C.

* * * * *